US010072517B2

(12) United States Patent
Boeke et al.

(10) Patent No.: US 10,072,517 B2
(45) Date of Patent: Sep. 11, 2018

(54) GAS TURBINE ENGINE COMPONENT HAVING VARIABLE WIDTH FEATHER SEAL SLOT

(71) Applicant: UNITED TECHNOLOGIES CORPORATION, Hartford, CT (US)

(72) Inventors: Mark A. Boeke, Plainville, CT (US); Kevin Rajchel, Vernon, CT (US); Richard M. Salzillo, Plantsville, CT (US); Jeffrey J. Degray, Hampden, MA (US); Allison Mainelli, Rockfall, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 433 days.

(21) Appl. No.: 14/769,210

(22) PCT Filed: Mar. 6, 2014

(86) PCT No.: PCT/US2014/020956
§ 371 (c)(1),
(2) Date: Aug. 20, 2015

(87) PCT Pub. No.: WO2014/138320
PCT Pub. Date: Sep. 12, 2014

(65) Prior Publication Data

US 2016/0003079 A1 Jan. 7, 2016

Related U.S. Application Data

(60) Provisional application No. 61/774,776, filed on Mar. 8, 2013.

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F05D 2240/11* (2013.01); *F05D 2240/57* (2013.01)

(58) Field of Classification Search
CPC ..... F01D 11/00; F01D 9/00
See application file for complete search history.

(56) References Cited

U.S. PATENT DOCUMENTS 4,524,980 A * 6/1985 Lillibridge ..... F01D 11/008 277/641
4,549,058 A 10/1985 DelMastro et al.
(Continued)

FOREIGN PATENT DOCUMENTS

EP 1798380 6/2007
EP 2586993 5/2013
(Continued)

OTHER PUBLICATIONS

Ihe Extended European Search Report for EP Application No. 14760315.3, dated Oct. 25, 2016.
(Continued)

*Primary Examiner* — Mark Laurenzi
*Assistant Examiner* — Shafiq Mian
(74) *Attorney, Agent, or Firm* — Carlson, Gaskey & Olds, P.C.

(57) ABSTRACT

A component for a gas turbine engine according to an exemplary aspect of the present disclosure includes, among other things, a mate face and a feather seal slot axially extending along the mate face, the feather seal slot having a variable width along a portion of its axial length.

20 Claims, 3 Drawing Sheets

(56) References Cited

U.S. PATENT DOCUMENTS

| | | | | |
|---|---|---|---|---|
| 5,531,457 | A | 7/1996 | Tibbott et al. | |
| 5,709,530 | A | 1/1998 | Cahill et al. | |
| 6,254,333 | B1 | 7/2001 | Merry | |
| 6,712,581 | B2 | 3/2004 | Florjancic et al. | |
| 7,600,967 | B2 | 10/2009 | Pezzetti, Jr. et al. | |
| 7,922,444 | B2 | 4/2011 | Propheter-Hinckley | |
| 8,152,454 | B2 * | 4/2012 | Khanin | F01D 9/041 415/135 |
| 8,182,208 | B2 | 5/2012 | Bridges, Jr. et al. | |
| 8,201,834 | B1 | 6/2012 | Liang | |
| 8,308,428 | B2 | 11/2012 | Bridges, Jr. et al. | |
| 8,727,710 | B2 * | 5/2014 | Propheter-Hinckley | F01D 11/005 415/139 |
| 2004/0047726 | A1 * | 3/2004 | Morrison | F01D 9/04 415/116 |
| 2006/0082074 | A1 * | 4/2006 | Synnott | F01D 11/005 277/641 |
| 2007/0104571 | A1 * | 5/2007 | Drerup | F01D 11/005 415/191 |
| 2007/0212214 | A1 * | 9/2007 | Paauwe | F01D 9/041 415/170.1 |
| 2010/0187762 | A1 * | 7/2010 | Heinz-Schwarzmaier | F01D 11/005 277/312 |
| 2011/0206501 | A1 | 8/2011 | Bergman et al. | |
| 2011/0233876 | A1 | 9/2011 | Bergman et al. | |
| 2012/0189424 | A1 | 7/2012 | Propheter-Hinckley et al. | |
| 2013/0108430 | A1 * | 5/2013 | Zimmermann | F01D 11/005 415/208.1 |

FOREIGN PATENT DOCUMENTS

| | | |
|---|---|---|
| FR | 2919345 | 1/2009 |
| WO | 89/00479 | 1/1989 |

OTHER PUBLICATIONS

International Search Report and Written Opinion of the International Searching Authority for International application No. PCT/US2014/020956 dated Jul. 7, 2014.

* cited by examiner

GAS TURBINE ENGINE COMPONENT HAVING VARIABLE WIDTH FEATHER SEAL SLOT

BACKGROUND

This disclosure relates to a gas turbine engine, and more particularly to a gas turbine engine component having a variable width feather seal slot.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

It may become necessary to seal between adjacent components of the gas turbine engine. For example, a vane ring structure of the gas turbine engine may be circumferentially arranged about a centerline axis of the engine. The vane ring structure may be segmented into a plurality of vane segments each having platform portions and airfoil portions. When assembled, the platforms abut and define the radially inner and outer flow boundaries of the core flow path.

The segmented configuration of the vane ring structure can result in gaps between the mate faces of adjacent components. These gaps must be sealed to prevent airflow leakage into and out of the core flow path. A feather seal may be positioned at the mate faces to seal these gaps.

SUMMARY

A component for a gas turbine engine according to an exemplary aspect of the present disclosure includes, among other things, a mate face and a feather seal slot axially extending along the mate face, the feather seal slot having a variable width along a portion of its axial length.

In a further non-limiting embodiment of the foregoing component, the component is a vane.

In a further non-limiting embodiment of either of the foregoing components, the vane is a turbine vane.

In a further non-limiting embodiment of any of the foregoing components, the mate face is part of a platform.

In a further non-limiting embodiment of any of the foregoing components, the component is part of a blade outer air seal (BOAS).

In a further non-limiting embodiment of any of the foregoing components, the feather seal slot includes a first axial slot portion of a first width and a second axial slot portion of a second width that is different from the first width.

In a further non-limiting embodiment of any of the foregoing components, the second width is smaller than the first width.

In a further non-limiting embodiment of any of the foregoing components, the feather seal slot includes a first axial slot portion, a second axial slot portion and a radial slot portion between the first axial slot portion and the second axial slot portion.

In a further non-limiting embodiment of any of the foregoing components, the first axial slot portion extends upstream of the radial slot portion and the second axial slot portion extends downstream of the radial slot portion.

In a further non-limiting embodiment of any of the foregoing components, a feather seal is received within the feather seal slot.

In a further non-limiting embodiment of any of the foregoing components, a first feather seal and a second feather seal are received within the feather seal slot.

In a further non-limiting embodiment of any of the foregoing components, the first feather seal extends within a first axial slot portion and a second axial slot portion of the feather seal slot and the second feather seal extends within the first axial slot portion but not within the second axial slot portion.

A gas turbine engine according to an exemplary aspect of the present disclosure includes, among other things, a first component having a first mate face and a second component having a second mate face circumferentially adjacent to the first mate face of the first component. At least one of the first mate face and the second mate face include a feather seal slot having a first axial slot portion of a first width and a second axial slot portion of a second width that is different from the first width. At least one feather seal is received within the feather seal slot.

In a further non-limiting embodiment of the foregoing gas turbine engine, the at least one feather seal includes a first feather seal and a second feather seal.

In a further non-limiting embodiment of either of the foregoing gas turbine engines, a bent portion of the second feather seal extends into a radial slot portion of the feather seal slot.

In a further non-limiting embodiment of any of the foregoing gas turbine engines, a radial slot portion intersects the feather seal slot between the first axial slot portion and the second axial slot portion.

A method of sealing between adjacent components of a gas turbine engine according to another exemplary aspect of the present disclosure includes, among other things, forming a feather seal slot having a variable width in a mate face of a component and positioning at least one feather seal within the feather seal slot.

In a further non-limiting embodiment of the foregoing method, the step of forming includes forming the feather seal slot to include a first axial slot portion of a first width and a second axial slot portion of a second width that smaller than the first width.

In a further non-limiting embodiment of either of the foregoing methods, the step of forming includes intersecting between the first axial slot portion and the second axial slot portion with a radial slot portion of the feather seal slot.

In a further non-limiting embodiment of any of the foregoing methods, the step of positioning includes loading a first feather seal into a first axial slot portion and a second axial slot portion of the feather seal slot and loading a second feather seal into the first axial slot portion but not the second axial slot portion.

The various features and advantages of this disclosure will become apparent to those skilled in the art from the following detailed description. The drawings that accompany the detailed description can be briefly described as follows.

DETAILED DESCRIPTION

Figure 1:
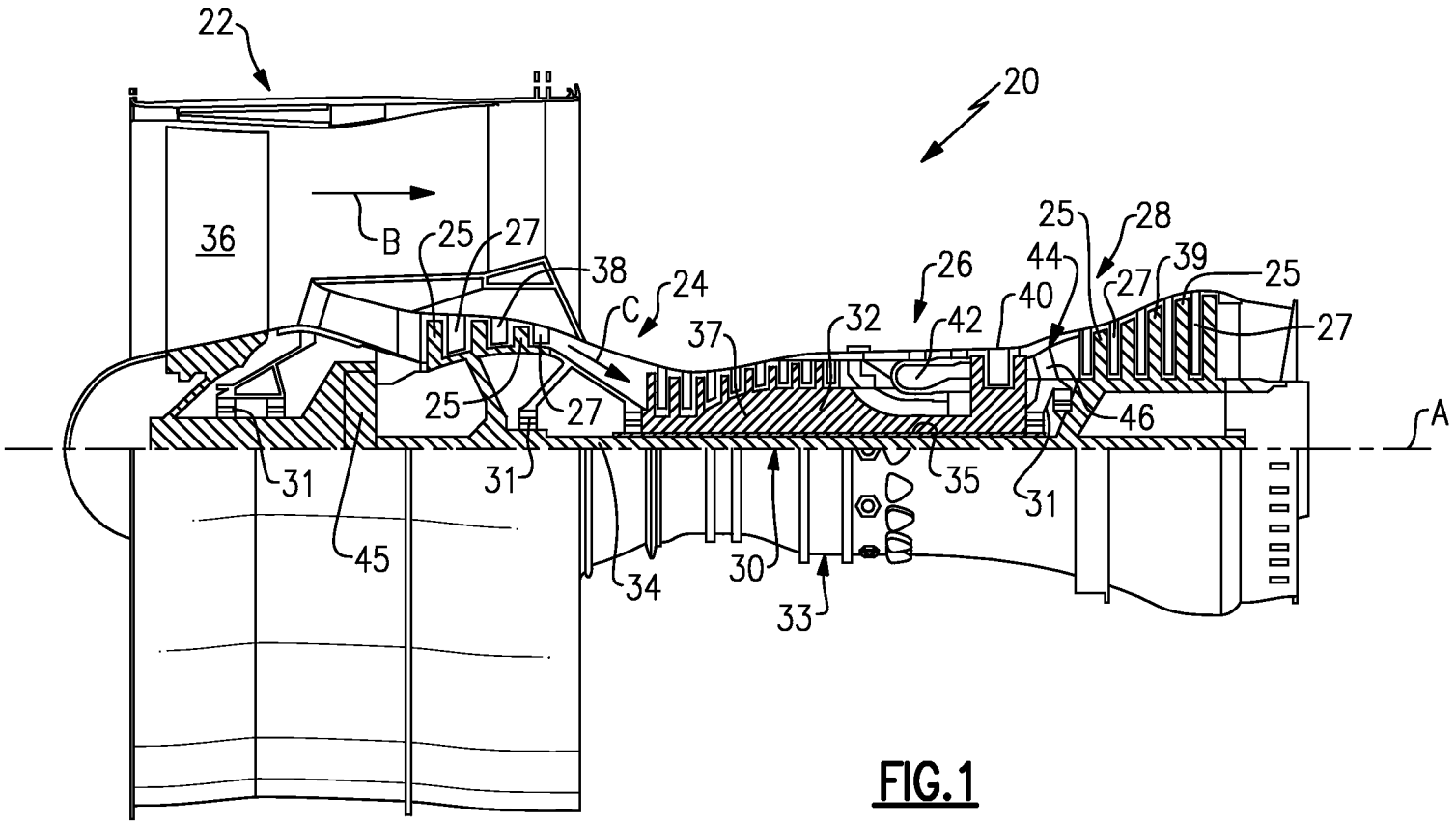
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}\ ^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

It may become necessary to seal between circumferentially adjacent components of the gas turbine engine 20. This disclosure relates to variable width feather seal slots that can be incorporated into abutting surfaces of adjacent components to seal the core flow path C from secondary flow leakage. Exemplary variable width feather seal slots are described in detail below.

Figure 2:
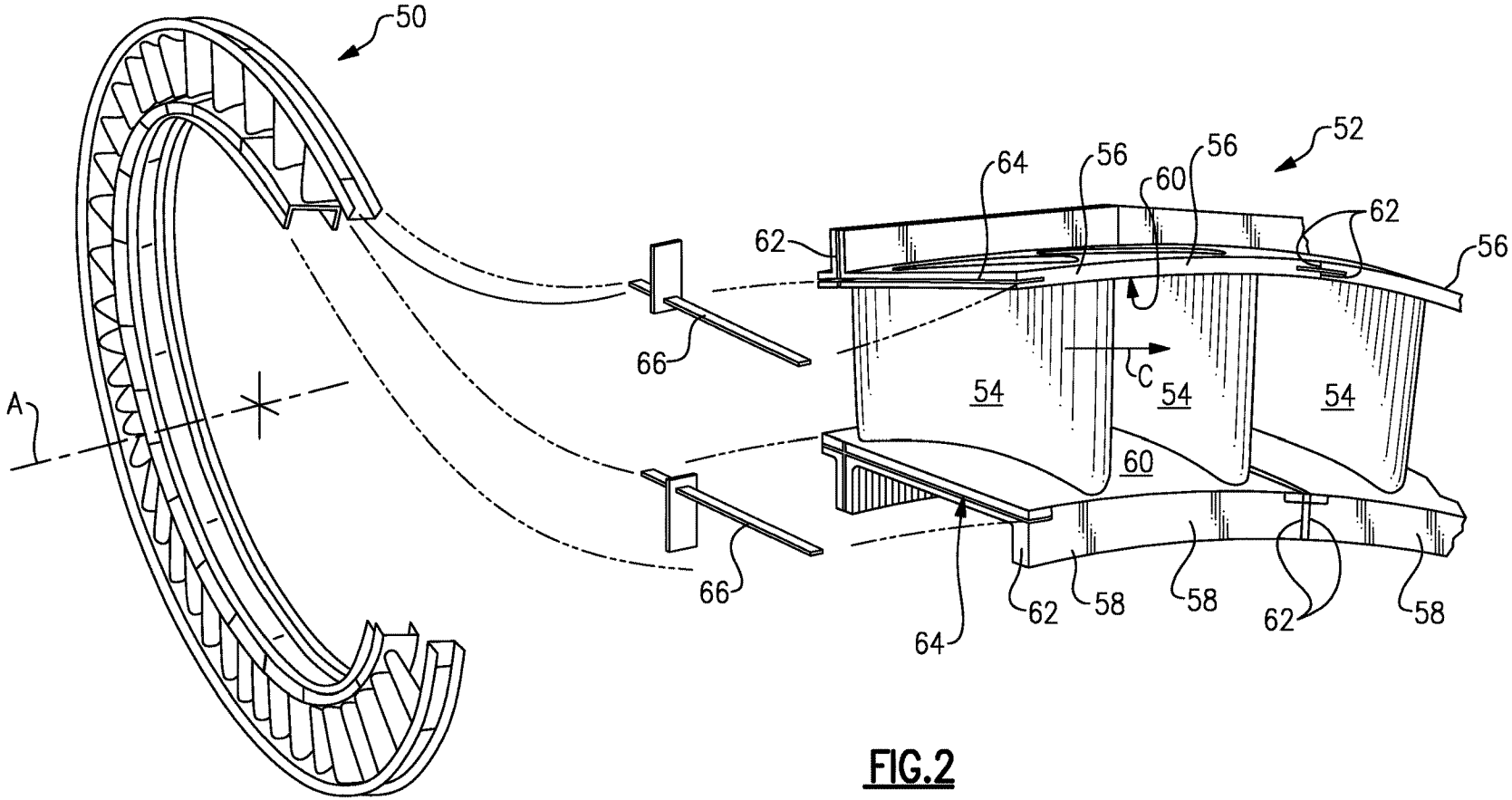
FIG. 2 illustrates a vane ring structure that can be incorporated into a gas turbine engine.

FIG. 2 illustrates an exploded view of a vane ring structure 50 that can be incorporated into a gas turbine engine, such as a gas turbine engine 20 of FIG. 1. For example, the vane ring structure 50 could be incorporated into either the compressor section 24 or the turbine section 28. Although the exemplary embodiments of this disclosure are illustrated with respect to vane segments of a vane ring structure, it should be understood that any component that must be sealed relative to an adjacent component could benefit from the teachings of this disclosure. For example, blade outer air seals (BOAS) could also benefit from a variable width feather seal slot.

The vane ring structure 50 includes a plurality of vane segments 52 that abut one another to form an annular ring circumferentially disposed about the engine centerline longitudinal axis A. Each vane segment 52 may include one or more circumferentially spaced apart airfoils 54 that radially extend between outer platforms 56 and inner platforms 58. Gas path surfaces 60 of each of the outer platform 56 and inner platform 58 establish the radially outer and inner flow boundaries of the core flow path C, which extends through the vane ring structure 50.

The circumferentially adjacent vane segments 52 abut one another at mate faces 62. In this embodiment, the mate faces 62 are disposed on the outer platform 56 and the inner platform 58 of each vane segment 52, although the mate faces 62 may be formed elsewhere. A feather seal slot 64 may be formed in the mate faces 62 of one or both of the outer platform 56 and the inner platform 58. One or more feather seals 66 are received within the feather seal slots 64 to seal between the adjacent vane segments 52.

Figure 3:
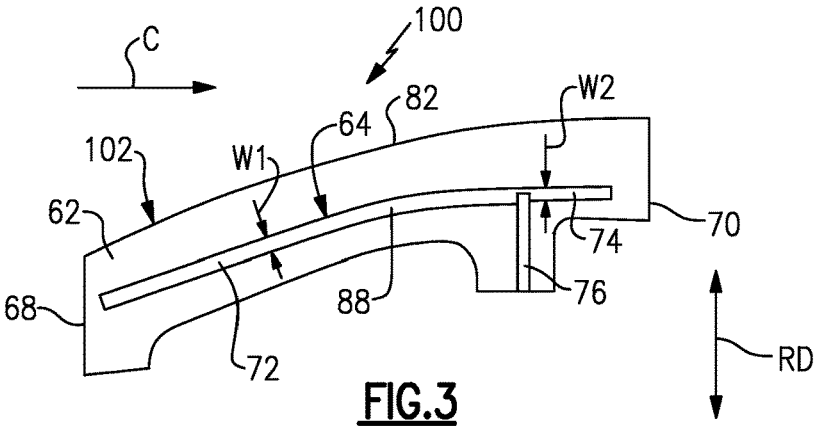
FIG. 3 illustrates one embodiment of a gas turbine engine component that includes a feather seal slot.

FIG. 3 illustrates an exemplary mate face 62 of a gas turbine engine component 100 (e.g., a vane, BOAS or another component that requires sealing relative to adjacent components). A feather seal slot 64 axially extends along the mate face 62 between a leading edge 68 and a trailing edge 70 of the mate face 62. In this embodiment, the mate face 62 is part of a platform 102 of the component 100. Although represented as an inner platform, a similar configuration could be incorporated into an outer platform.

The feather seal slot 64 extends substantially across an entire axial width of the mate face 62, in this embodiment. However, the feather seal slot 64 may embody any axial width within the scope of this disclosure.

The exemplary feather seal slot 64 includes a variable width. For example, the feather seal slot 64 can include a first axial slot portion 72 of a first width W1 and a second axial slot portion 74 of a second width W2 that is different than the first width W1. In this embodiment, the second width W2 is smaller than the first width W1 in a radial direction RD. Of course, other design configurations are also contemplated.

The feather seal slot 64 may additionally include a radial slot portion 76 that is transverse to the first axial slot portion 72 and the second axial slot portion 74. In one embodiment, the first axial slot portion 72 extends upstream from the radial slot portion 76 and the second axial slot portion 74 extends downstream from the radial slot portion 76. The upstream and downstream directions are referenced from a direction of airflow through the core flow path C.

The radial slot portion 76 can intersect between the first axial slot portion 72 and the second axial slot portion 74, as discussed in more detail below. In one embodiment, the radial slot portion 76 extends into a radial segment 78 of the component 100. For example, the radial segment 78 may be an attachment rail of the platform 102.

The platform 102 of the component 100 may include a contoured surface 82. Because of the contoured surface 82, one or both of the first axial slot portion 72 and the second axial slot portion 74 can include a curved portions. In this embodiment, the first axial slot portion 72 includes a curved portion 88 such that it extends non-linearly along the mate face 62, whereas the second axial slot portion 74 and the radial slot portion 76 are substantially linear.

Figure 4:
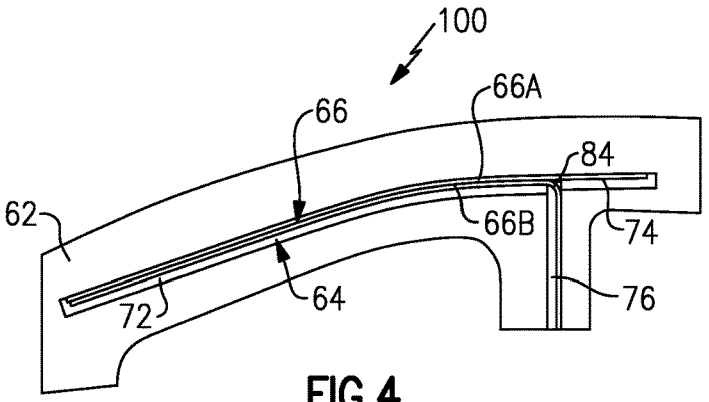
FIG. 4 illustrates another embodiment.

Referring to FIG. 4, at least one feather seal 66 can be loaded into the feather seal slot 64 to seal the component 100 relative to an adjacent component. A first feather seal 66A and a second feather seal 66B are inserted into the feather seal slot 64 in the illustrated embodiment. In one embodiment, the first feather seal 66A and the second feather seal 66B are separate seals that may abut one another within the feather seal slot 64. Alternatively, the first feather seal 66A and the second feather seal 66B could be attached as a seal assembly.

The first feather seal 66A can extend within the first axial slot portion 72 as well as within the second axial slot portion 74. The second feather seal 66B can extend within the first axial slot portion 72 but is not inserted within the second axial slot portion 74. Instead, the second feather seal 66B includes a bent portion 84 that extends from the first axial slot portion 72 into the radial slot portion 76. In other words, the second axial slot portion 74 is only loaded with a portion of the first feather seal 66A, whereas the first axial slot portion 72 is loaded with both the first feather seal 66A and the second feather seal 66B.

Figure 5:
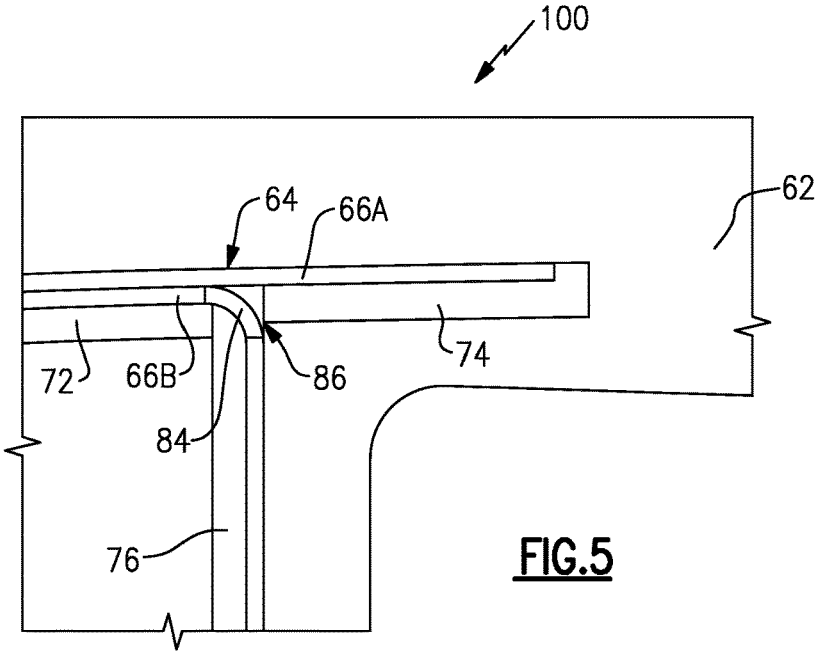
FIG. 5 illustrates additional features of an exemplary feather seal slot.

FIG. 5 illustrates additional features that may be incorporated into an exemplary feather seal slot 64. The radial slot portion 76 intersects between the first axial slot portion 72 and the second axial slot portion 74 of the feather seal slot 64. A step 86 is formed between the first axial slot portion 72 and the second axial slot portion 74 because of the variable width that exists between the first axial slot portion 72 and the second axial slot portion 74. The bent portion 84 of the second feather seal 66B extends at this step 86 to block airflow leakage from the second axial slot portion 74 into the radial slot portion 76.

The exemplary feather seal slot 64 of this disclosure provides a reduced leakage path area at the feather seal 66, resulting in less secondary flow leakage. In addition, because of the variable width of the exemplary feather seal slot 64, the second axial slot portion 74 can be extended further axially rearward along the mate face 62 of the component 100.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component for a gas turbine engine, comprising:
a mate face; and
a feather seal slot axially extending along said mate face, said feather seal slot having a variable width along a portion of its axial length;
wherein said feather seal slot includes a first axial slot portion of a first width, a second axial slot portion of a second width, and radial slot portion between said first axial slot portion and said second axial slot portion; and
wherein said second width of said second slot portion is different from said first width of said first axial slot portion;
wherein a radially extending step is formed before said first axial slot portion and said second axial slot portion.

2. The component as recited in claim 1, wherein said component is a vane.

3. The component as recited in claim 2, wherein said vane is a turbine vane.

4. The component as recited in claim 1, wherein said mate face is part of a platform.

5. The component as recited in claim 1, wherein said component is part of a blade outer air seal (BOAS).

6. The component as recited in claim 1, wherein said second width is smaller than said first width.

7. The component as recited in claim 1, wherein said first axial slot portion extends upstream of said radial slot portion and said second axial slot portion extends downstream of said radial slot portion.

8. The component as recited in claim 1, comprising a feather seal received within said feather seal slot.

9. The component as recited in claim 1, comprising a first feather seal and a second feather seal received within said feather seal slot.

10. The component as recited in claim 9, wherein said first feather seal extends within said first axial slot portion and said second axial slot portion of said feather seal slot, and said second feather seal extends within said first axial slot portion but not within said second axial slot portion.

11. A gas turbine engine, comprising:

a first component having a first mate face;

a second component having a second mate face circumferentially adjacent to said first mate face of said first component;

wherein at least one of said first mate face and said second mate face include a feather seal slot having a first axial slot portion of a first width, a second axial slot portion of a second width, and a radial slot portion that intersects said feather seal slot between said first axial slot portion and said second slot portion;

wherein said second width of said second slot portion is different from said first width of said first slot portion;

wherein a radially extending step is formed between said first slot portion and said second slot portion; and at least one feather seal received within said feather seal slot.

12. The gas turbine engine as recited in claim 11, wherein said at least one feather seal includes a first feather seal and a second feather seal.

13. The gas turbine engine as recited in claim 12, wherein a bent portion of said second feather seal extends into said radial slot portion of said feather seal slot.

14. A method of sealing between adjacent components of a gas turbine engine, comprising the steps of:

forming a feather seal slot having a variable width in a mate face of a component;

positioning at least one feather seal within the feather seal slot;

wherein the step of forming includes forming the feather seal slot to include a first axial slot portion of a first width and a second axial slot portion of a second width that is smaller than the first width;

wherein a radially extending step is formed between the first axial slot portion and the second axial slot portion; and wherein the step of forming includes intersecting between the first axial slot portion and the second axial slot portion with a radial slot portion of the feather seal slot.

15. The method as recited in claim 14, wherein the step of positioning includes:

loading a first feather seal into the first axial slot portion and the second axial slot portion of the feather seal slot; and loading a second feather seal into the first axial slot portion but not the second axial slot portion.

16. The component as recited in claim 10, wherein a bent portion of said second feather seal extends into said radial slot portion of said feather seal slot such that said second feather seal abuts against a radially extending wall of said radial slot portion that defines said radially extending step.

17. The component as recited in claim 16, wherein said first axial slot portion is defined by an outer wall and an opposed inner wall that each extend from a first end to a second end, said first end adjacent to a leading edge of said mate face, and said second end terminating at said radial slot portion.

18. The gas turbine engine as recited in claim 13, wherein said second width is smaller than said first width.

19. The gas turbine engine as recited in claim 18, wherein first axial slot portion is defined by an outer wall and an opposed inner wall that each extend from a first end to a second end, said first end adjacent to a leading edge of said at least one of said first mate face and said second mate face, and said second end terminating at said radial slot portion.

20. The method as recited in claim 14, wherein:

a bent portion of said second feather seal extends into said radial slot portion of said feather seal slot such that said second feather seal abuts against a radially extending wall of said radial slot portion that defines said radially extending step;

said first axial slot portion is defined by an outer wall and an opposed inner wall that each extend from a first end to a second end, said first end adjacent to a leading edge of said mate face, and said second end terminating at said radial slot portion; and said component includes an airfoil extending from a platform that defines said mate face.

* * * * *